US005246117A

United States Patent [19]

Zivley

[11] Patent Number: 5,246,117

[45] Date of Patent: Sep. 21, 1993

[54] SORTING MACHINE INCLUDING PRODUCT LENGTH INSPECTION

[75] Inventor: George A. Zivley, Houston, Tex.

[73] Assignee: ESM International, Inc., Houston, Tex.

[21] Appl. No.: 753,207

[22] Filed: Aug. 30, 1991

Related U.S. Application Data

[63] Continuation-in-part of Ser. No. 519,886, May 7, 1990, Pat. No. 5,062,532.

[51] Int. Cl.[5] ..... B07C 5/04

[52] U.S. Cl. ..... 209/586; 209/559; 209/581; 356/383; 356/385; 377/20; 377/24

[58] Field of Search ..... 209/555, 556, 558, 559, 209/566, 576, 577, 586, 580, 581; 356/383-386; 377/6, 20, 24; 250/560

[56] References Cited

U.S. PATENT DOCUMENTS 4,754,881 7/1988 Bohle ..... 209/586 X
4,784,275 11/1988 Fridge ..... 209/580 X
4,787,620 11/1988 Goldkuhle ..... 209/555 X
4,875,776 10/1989 Pryar ..... 209/586 X
5,062,128 10/1991 Katsuragi et al. ..... 377/20 X
5,062,532 11/1991 Zivley ..... 209/581

FOREIGN PATENT DOCUMENTS 3611926 10/1987 Fed. Rep. of Germany ..... 209/586

*Primary Examiner*—Joseph E. Valenza
*Assistant Examiner*—Tuan N. Nguyen
*Attorney, Agent, or Firm*—Vaden, Eickenroht, Thompson, Boulware & Feather

[57] ABSTRACT

A sorting machine is disclosed based on a procedure utilizing standard length pulses initiated by the sensing of the leading edge of a sensed product and rejecting a defective product based on sensing where its trailing edge is or should be if covered up by a successive overlapping product. Such detection allows for rejecting products that are either too long or too short. The detection of the trailing edge location also is employed for the activation of a reject mechanism operated on a fixed delay from the occurrence of a defect signal for whatever reason produced from the sensing of a product in the product stream.

7 Claims, 5 Drawing Sheets

SORTING MACHINE INCLUDING PRODUCT LENGTH INSPECTION

This application is a continuation-in-part of copending application Ser. No. 07/519,886, filed May 7, 1990, now U.S. Pat. No. 5,062,532.

BACKGROUND OF THE INVENTION

1. Field of the Invention

This invention pertains to sorting machines used to sort fungible products, such as nuts and many other agricultural products, by passing the products along a channel having a viewing window and detecting products that are nonstandard in length from those that are within a range of standard sizes and rejecting those that are nonstandard.

2. Description of the Prior Art

A typical sorter of fungible products of the type just described is comprised of one or more channels that are gravity fed from a top loaded hopper, the products flowing in each of the channels in a fairly constant stream and sometime overlapping one another. The channel includes or leads to a viewing window through which the stream of flowing products are electro-optically observed by at least one photodetector to produce an output when there is a product in the window. Although only one photodetector is used in a very simple machine, it is common to employ multiple photodetectors, for example, three, for viewing the product flow from various viewing angles.

A product can be sorted on the basis of one or more criteria, including variance in overall color, variance in spot coloration, variance in length because of being either abnormally small or abnormally long. When a substandard product is viewed or sensed, a reject signal is produced that, following a suitable delay, results in the activation of a reject mechanism, which diverts the substandard product from the channel. The delay is necessary for the product to fall below the viewing window and be opposite the reject mechanism. The reject mechanism is typically a burst or jet of air that blows the substandard product out of the ordinary channel flow to cause the rejected product to drop into a reject bin.

Heretofore, it has been virtually impossible to sort by prior art machines products that are either abnormally long or abnormally short. That is, in many cases, broken pieces are desirably discriminated against and rejected as being substandard by being abnormally short. Abnormally long pieces are sometimes also considered substandard for a particular purpose and are rejected. For example, abnormally long almonds are not desirable for use in a candy bar.

When products are viewed singly by the prior art machines, they can be discriminated against since standard products would occupy an acceptable percentage of the overall viewing window or, alternatively, products that are substandard would occupy an abnormally small or large percentage of the overall viewing window. However, when the product flow is fast, as it desirably is with the newer machines, mistakes on this basis of discrimination do occur because of product overlap. A broken piece, that would be a substandard small product, may get by when included in the viewing window with at least part of another product. Perfectly acceptably sized products may be rejected when they appear together by being mistaken for an abnormally long product.

It is also important to time the reject mechanism consistently with the same part of the product, regardless of where a defect in a product is detected. For example, in a sorting machine operation actuating on spot detection, prior art machines timed the delay to activation of the reject mechanism based upon where the spot occurs. If the spot on a first product is located on the leading edge, the delay would be from the detection of the leading edge. If the spot on a second product is located on the trailing edge, the delay would be from the detection of the trailing edge. For a nominal setting of reject being based on a center spot location, one or both of the previous products might escape rejection.

It is therefore a feature of the present invention to provide improved timing of the reject mechanism in a sorting machine by applying digital timing techniques to always activate the reject mechanism from the detection of the trailing edge of the product to be rejected and to cause such rejection even when the trailing edge might be actually nondetectable because of product overlap in the viewing window.

SUMMARY OF THE INVENTION

An electro-optical photodetector array of linear photodiodes are employed for viewing the viewing window of a sorting machine channel so as to effectively divide the viewing window into a succession of photo sites, sometimes also referred to as "pixels". Typically, such photo sites are about 0.01 inch high and 0.001 inch wide. A complete coverage of a typical viewing window is accomplished by 128 to 1024 photodiodes; however, 256 of such photodiodes are employed in the preferred embodiment. The viewing window is normalized by scanning through the sequence or succession of photodiodes using a timing-and-control network utilizing a timing oscillator having a multi-phase clock output. Typically, such an oscillator operates at 1.0 or 2.0 mega Hertz. Each photodiode successively produces an electrical output during its sample period of time.

The circuit that assures proper timing may be used in conjunction with circuits suitable for other circuit functions of a specific sorting machine, or may be used independently thereof. In the attached specification, circuits are disclosed for normalizing sensitivity because of variations in background and for spot size rejection.

The circuit that assures proper timing of the reject mechanism includes separately detecting the leading and trailing edges of products in the viewing window with a photodetector. For a typical product that is to be rejected for a reason not related to length, usually because of being nonstandard in overall color or having an excessively large spot, the reject mechanism is activated, after an appropriate delay, by the detected trailing edge. This occurs whenever a product is classified as substandard for rejection purposes during the period the product is observed. A crowding of the products may, however, obscure the trailing edge of a product. Thus, a gated oscillator timer is also activated with the detection of the leading edge to produce an artificial "trailing edge" signal at a time following the detection of the leading edge for typical length products. If no actual trailing edge is detected for a product classified as a substandard reject by the time the artificial trailing edge signal of the gated oscillator occurs, this signal will cause the reject mechanism to activate, after the appropriate delay time.

The scheme for detecting the edges of the product just discussed can also be used, if desired, to initiate a network for discriminating against products on the basis of length alone. In such a case, the detection of the leading edge of a product initiates a monostable timer device having a period equal to the minimum length product. If the trailing edge of a product is detected while the monostable timer device is on, then the product is too short and a reject signal is produced.

The gated oscillator period may be set for a maximum product length. Therefore, if it is into a second period before the trailing edge of a product is detected, this can be used as an indication that the product being detected is abnormally long and should be rejected for that reason. The leading edge of the second period starts the monostable timer again, which may be on when the actual trailing edge of the product occurs. Thus, a reject signal is produced in the same manner as for the product that is too short.

Also provided is a means for reversing the rejection mechanism to activate on the detection of acceptable products and pass substandard products. This is done, for example, for recovering good products from heavily contaminated products. This is done by enabling the reject mechanism with the detection of the leading edge of a product and canceling the enablement with the receipt of a reject signal from the classification circuitry. This "reverse fire" capability is provided by a switch selectable by the operator.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the drawings illustrate only preferred embodiments of the invention and is therefore not to be considered limiting of its scope as the invention may admit to other equally effective embodiments.

In the drawings.

DESCRIPTION OF THE PREFERRED EMBODIMENTS

Figure 6:
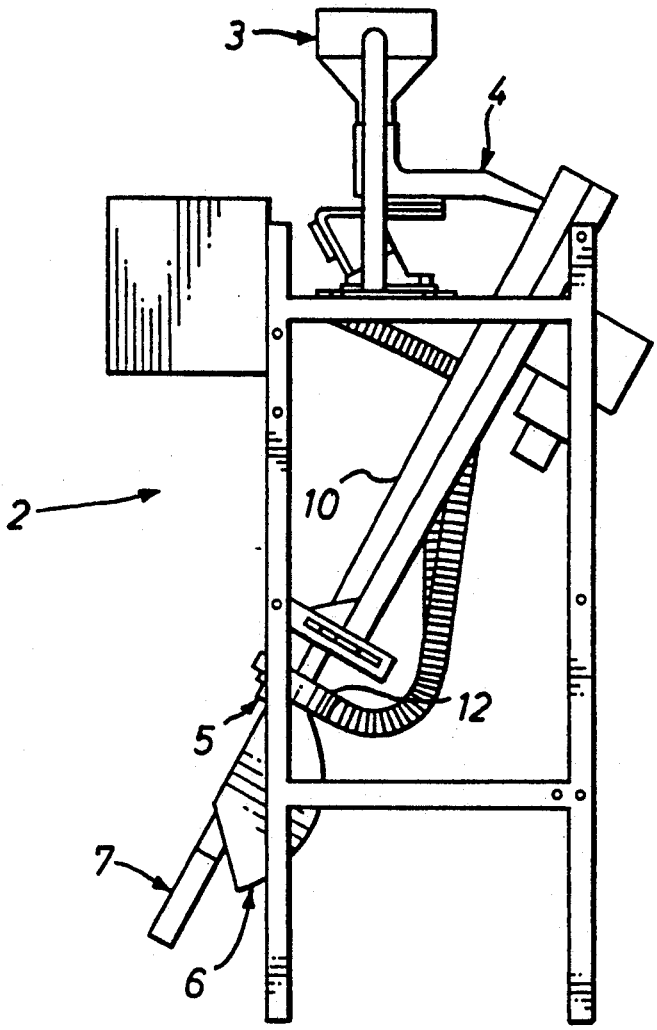
FIG. 6 (PRIOR ART)
FIG. 6 is a diagrammatic representation of a typical prior art sorting machine for sorting fungible products.

Now referring to the drawing and first to FIG. 6, a machine for sorting fungible products, generally referred to be the numeral 2, is shown. From hopper 3, product is fed through feeder 4 into chute 10 and passed through viewing window area 12. If the product is unacceptable, ejector 5 is activated to eject the product in reject accumulator 6.

Figure 1:
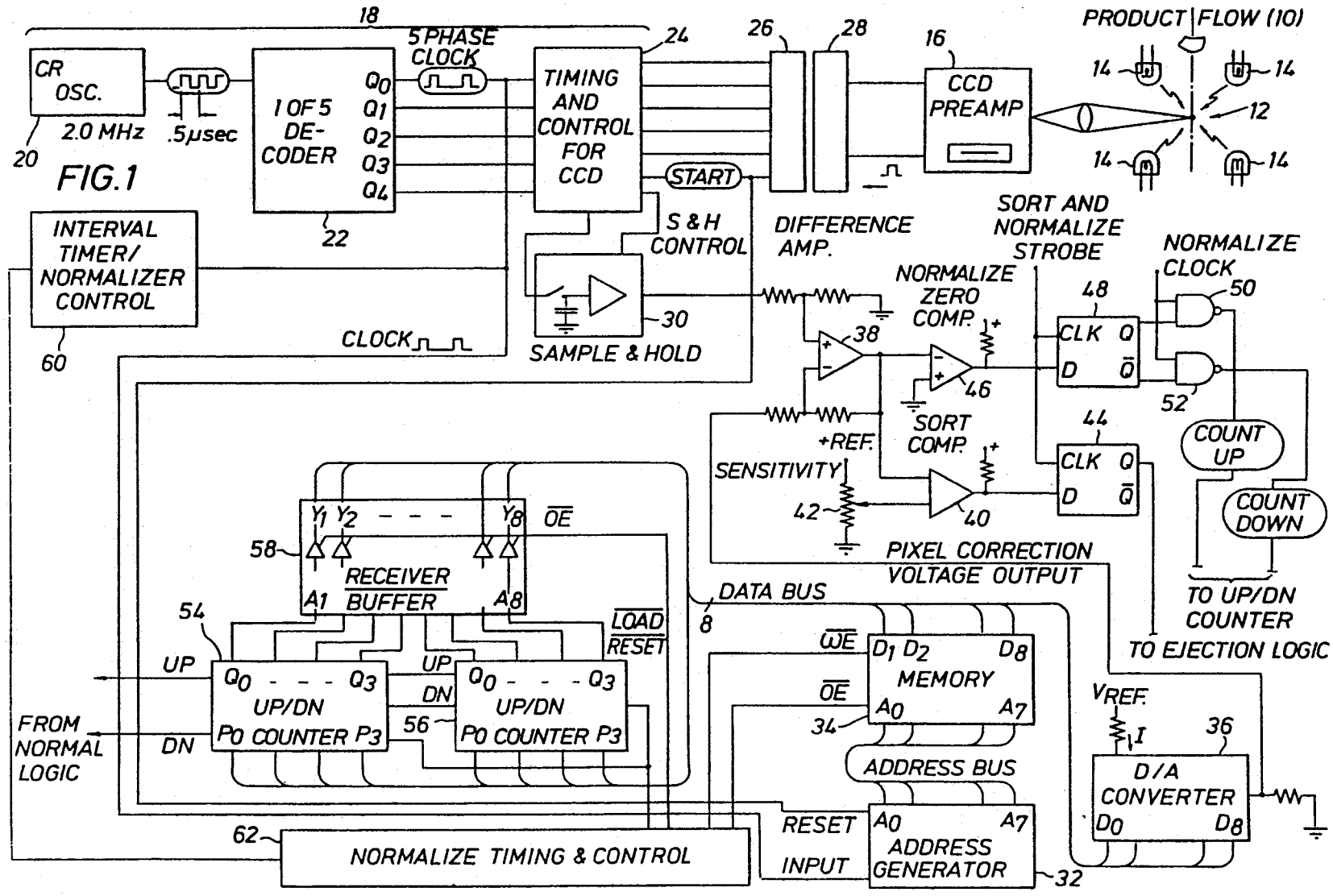
FIG. 1 is a block diagram of a portion of a sorting machine circuit utilizing photo site detection for normalizing and sorting operation with respect to normalizing in accordance with a preferred embodiment of the present invention.

Referring to FIG. 1, a partial operating block diagram is shown in accordance with a preferred embodiment of the present invention. A channel of product flow 10 is shown passing through a frame or a viewing window area 12 brightly illuminated by a system of lights 14. Although four lights are shown, a greater or lesser number can be employed. The main purpose of the lighting system is to cause the products to exhibit a bright light intensity and to eliminate any shadows as much as possible. A photodetector 16 in the form of a photodiode or a charge coupled diode, a related optical system and a CCD preamplifier is shown focused on a photo site in the viewing window. Each photo site or pixel is one measurement unit high for the photodiode being used, typically on the order of 0.01 inch, and one unit wide, typically on the order of 0.001 inch. An acceptable photodiode array is one of the K Series of wide aperture linear arrays (RL1024K, RL0512K, RL0256K, and RL0128K) made by EG&G Reticon. The RL0256K array of 256 photodiodes has been successfully employed. Each of the photodiodes in the array develops an equivalent analog electrical output signal proportional to the viewed light intensity during the period of time each successive diode is activated. The entire viewing window is viewed by the succession of activations of the photodiodes in the array.

A timing-and-control network 18 includes a high frequency oscillator 20, which preferably operates at 1.0 megaHertz. For convenience, a clock phaser 22 develops a series of phased clock pulses, as shown on the first five lines of FIG. 2, for providing the clock operation of CCD controller network 24 and for other clocking purposes. The control outputs to the photodetectors and the developed signals therefrom are supplied via suitable connectors 26 and 28. Only one photodetector is shown for convenience, but the others are similarly operated.

When the time is appropriate to activate photodetector 16, a suitable start or activate signal is produced, which results in an electrical output proportional to the photodetector response during the sampling time period at an appropriate time, the signal progressing through controller network 24 to a sample-and-hold device 30.

A coordinated clock pulse also activates address generator 32, which, in turn, selects from the position of memory device 34 the stored normalized value stored therein associated with photodetector 16. This value is applied, following digital-to-analog conversion in D-to-A converter 36, to difference amplifier 38 simultaneously with the application of the stored photodetector signal from sample-and-hold device 30. The difference value, which can be either positive or negative depending on whether the photodetector signal is larger or smaller than the stored normalized value, is applied to sort comparator 40, which has a preset sensitivity input level or reference 42 applied thereto. If the applied difference value from difference amplifier 38 is larger than the sensitivity level set, then a defect output pulse is produced from D flip-flop 44 connected to the output of the sort comparator. The ejection logic (not shown in FIG. 1) receives the defect output and produces an ejection signal when a related number of these defect outputs occur in a manner hereafter explained. After the normalize value has been used, the value is returned to the appropriate position in memory device 34 until the same corresponding viewing photodiode is again activated during the next iterative scanning of the photodetectors. The remaining photodetectors are sequentially activated in like manner to develop defect outputs when each respective detected photodetector signal exceeds by a predetermined difference the respective associated normalized value drawn from memory device 34.

Periodically, for example, every twenty minutes, the sorting machine switches from the sorting mode just described to the normalizing mode.

In the normalizing mode, product flow is suspended and the photodetectors view only the background of the channel through the viewing window. Operation is the same as for the sorting mode, except sort comparator 40 is disenabled and normalizer zero comparator 46 is enabled and the memory devices are allowed to be updated. The comparison input for comparator 46 is ground or circuit normal (zero) so that the output therefrom, which is the difference from the difference amplifier, produces either a positive or negative output to D flip-flop 48. A positive (or alternatively, a negative) output produces for each clock count through a buffer amplifier 50 a digital "count up" signal and a negative (or alternatively, a positive) output produces for each clock count through a buffer amplifier 52 a digital "count down" signal. The logic signals from buffer amplifiers 50 and 52 are provided to up/down counters 54 and 56, which, through receiver buffer network 58 cause each affected memory position value to be incrementally raised or lowered prior to restorage in memory 34.

Timing-and-control network 18 operates in the normalizing mode for about two seconds as determined by controllers 60 and 62, which allow the iterative enablements of the photodetectors and the memory position value adjustments to take place as above described until the values stored corresponding to each photodetector is a normalized product value determined by the light intensity of its respective photo site as detected by its respective photodetector. Each photodetector is typically only within about 10% in sensitivity to a nominal standard value. The normalized value stored is therefore a product of each of the absolute values of light intensity of the photo site background and the sensitivity of the photodetector that operates at that photo site. Since the same photodetector is employed at each photo site for sorting purposes, the individual normalization is appropriate to remove the photodetector variations from the absolute values of light intensities that relate solely to the product flow in the viewing window at the respective photo sites.

Figure 2:
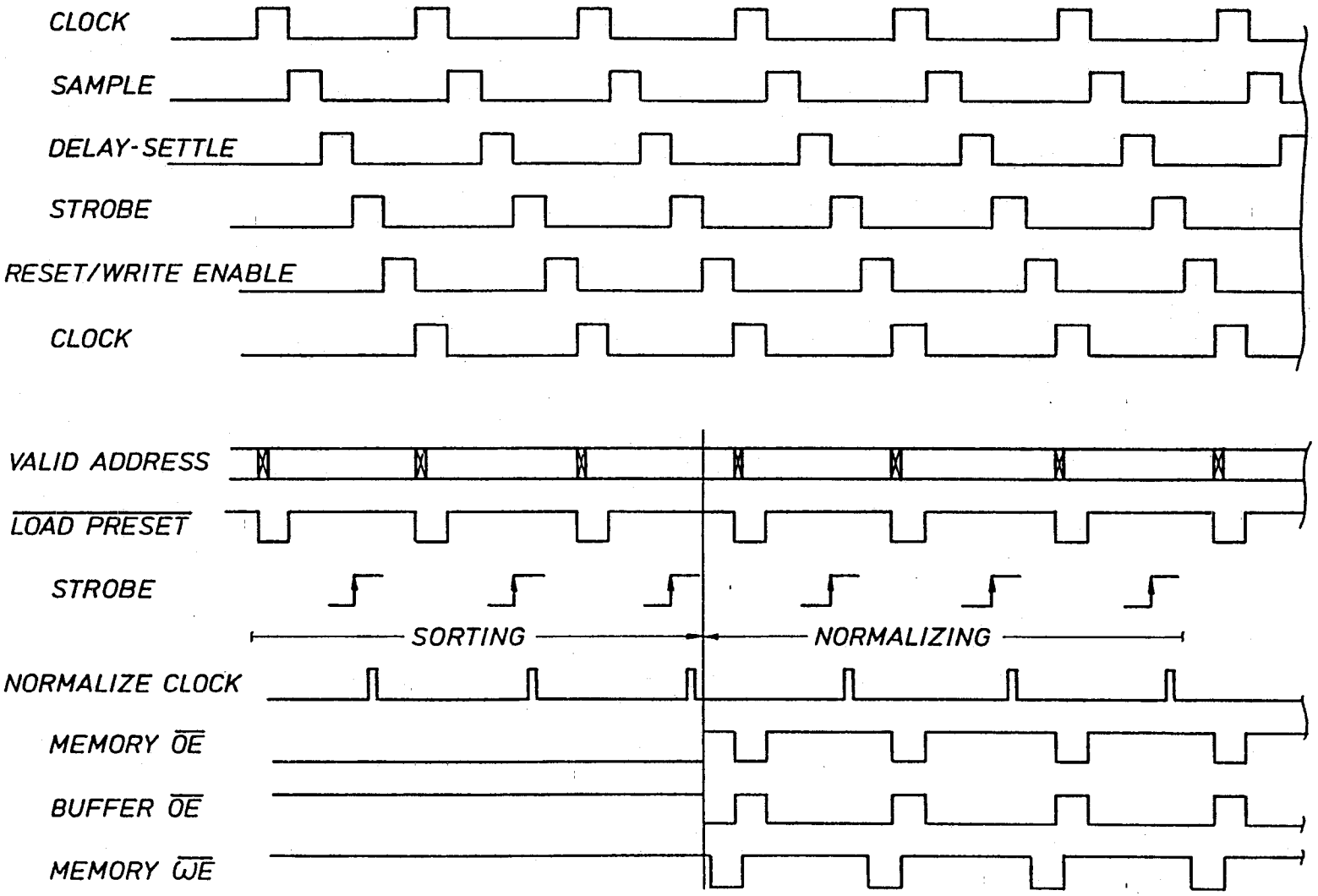
FIG. 2 is a timing diagram of the operation of the circuit shown in FIG. 1 in both its normal sorting operation mode and in its normalizing mode.

FIG. 2 shows the waveform operation including the possibility of writing into the memory network at appropriate times when the circuit is operating in the normalizing mode.

Figure 3:
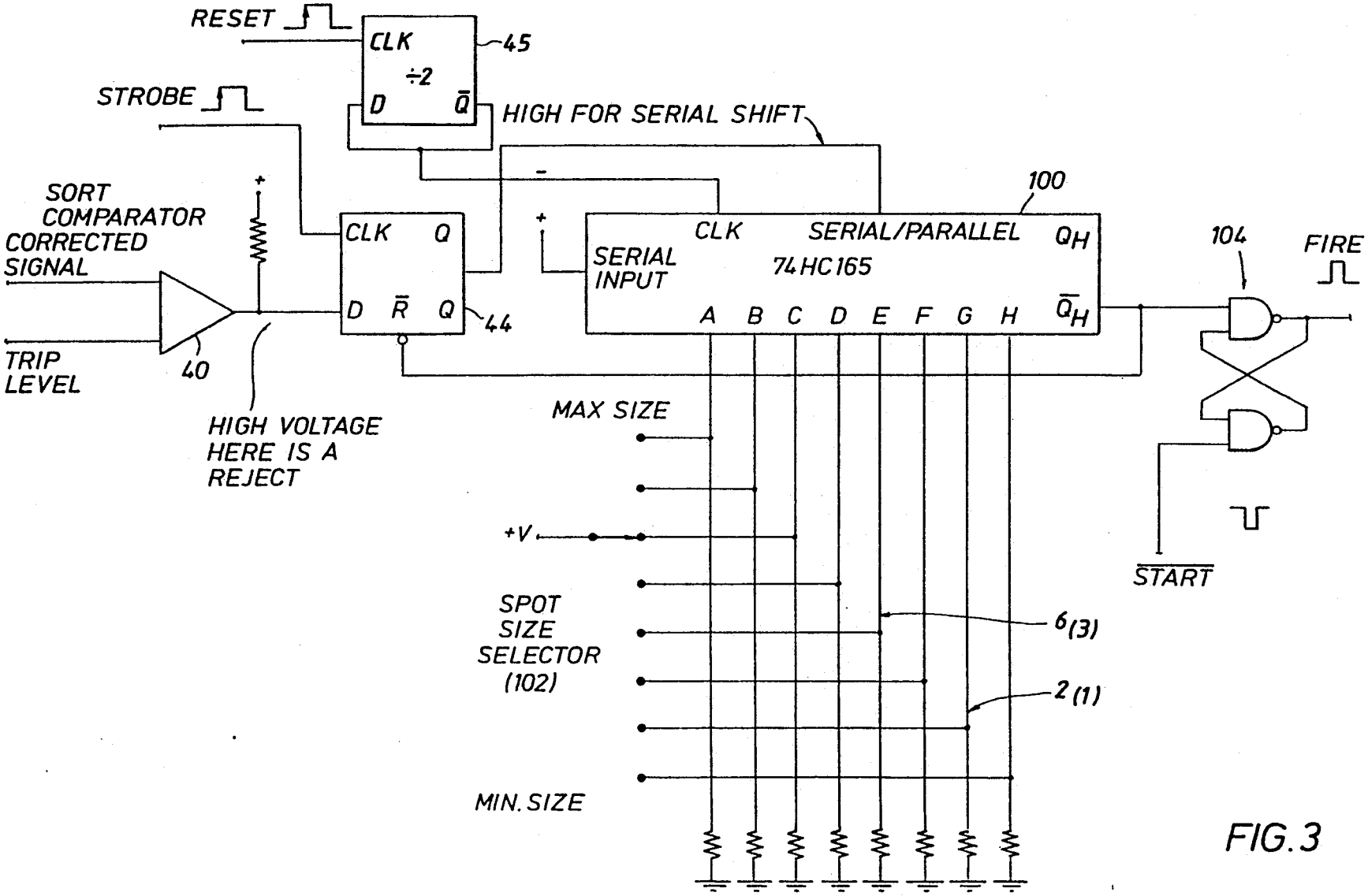
FIG. 3. is a block diagram of a portion of a sorting machine operating to classify as a rejection defect a spot of a predetermined size.

Now referring to FIG. 3, a block diagram of a circuit is shown suitable for classifying a defect of a predetermined size as sufficiently large for rejection purposes. The circuit is connectable to the circuit of FIG. 1 as may be seen by sort comparator 40 and D flip-flop 4 appearing in both illustrations and D flip-flop 45 appearing in FIG. 3. The function of D flip-flop 45 is a frequency divider. The input to D flip-flop 45 is the clock phase labelled reset, which immediately follows the strobe phase as detailed in FIG. 2. Thus, the output of D flip-flop 45 is a pulse train at half the frequency of the data derived from the CCD device. The rising edge of this pulse is the clock input to the shift register. Each rising edge advances shift register 100 by one position.

The key element of the "sizer" shown in FIG. 3 is a shift register 100 capable of two modes of operation, namely (1) parallel load and (2) serial load and serial shift. The size of the defect predetermined to cause reject is determined by a size control selector switch 102, which is arbitrarily for illustrative purposes set up for position C of the timer. Position C means that five consecutive clock inputs to the shift register 100 would have to occur with all product data indicating defective product in the view for the product to be rejected. As the shift register clock input is running at half the CCD data clock rate, then 1 consecutive defect signals are required. Thus, it can be seen that the function of D flip-flop 45 is a "times two" range scaler for spot size selector switch 102.

Therefore, for the example where each photo site is 0.001 inch long, a total length of defect of 0.010 inch, as measured at the CCD, would be required to activate the reject mechanism. The actual size of the defect would depend upon the magnification ratio of the optics.

From the drawing, it will be seen for the exemplary register, which can be type number 74HC165, sizing can be from a two photo-site long spot (when switch 100 is connected to input G) to a fourteen photo-site long (when switch 100 is connected to input A). Note that the input from switch 102 to input G is marked 2(1), which means that for the user, a setting of "1" achieves a "2" pixel setting. In like fashion, the input from switch 102 to input E is marked 6(3), which means that for the user, a setting of "3" achieves a "6" pixel setting. In effect, the settings are in multiples of two. Obviously, other registers with a different number of input positions can be employed, if desired.

Upon the encountering of a defect, a latch output is produced from D flip-flop 44 to set the mode of operation of the shift register, serial input and serial shift. The input of the maximum pixel count is also put into the selected position, or position C for the illustrated example. If successive photo sites or pixels are also scored as defects, the single bit will be continually shifted toward the serial output stage. Should a single pixel arrive that is not scored as a defect, the latch action of D flip-flop 44 will be reset and the register will revert to parallel load mode, the bit in the register being erased.

When a string of pixels scored as defects exceeds the number determined by the spot size selection requirement, the selected bit will reach the serial output stage and will trigger a reject pulse from network 104. The initiation of a reject pulse also resets latch 44 and register 100 in anticipation of the next cycle of operation.

Figure 4:
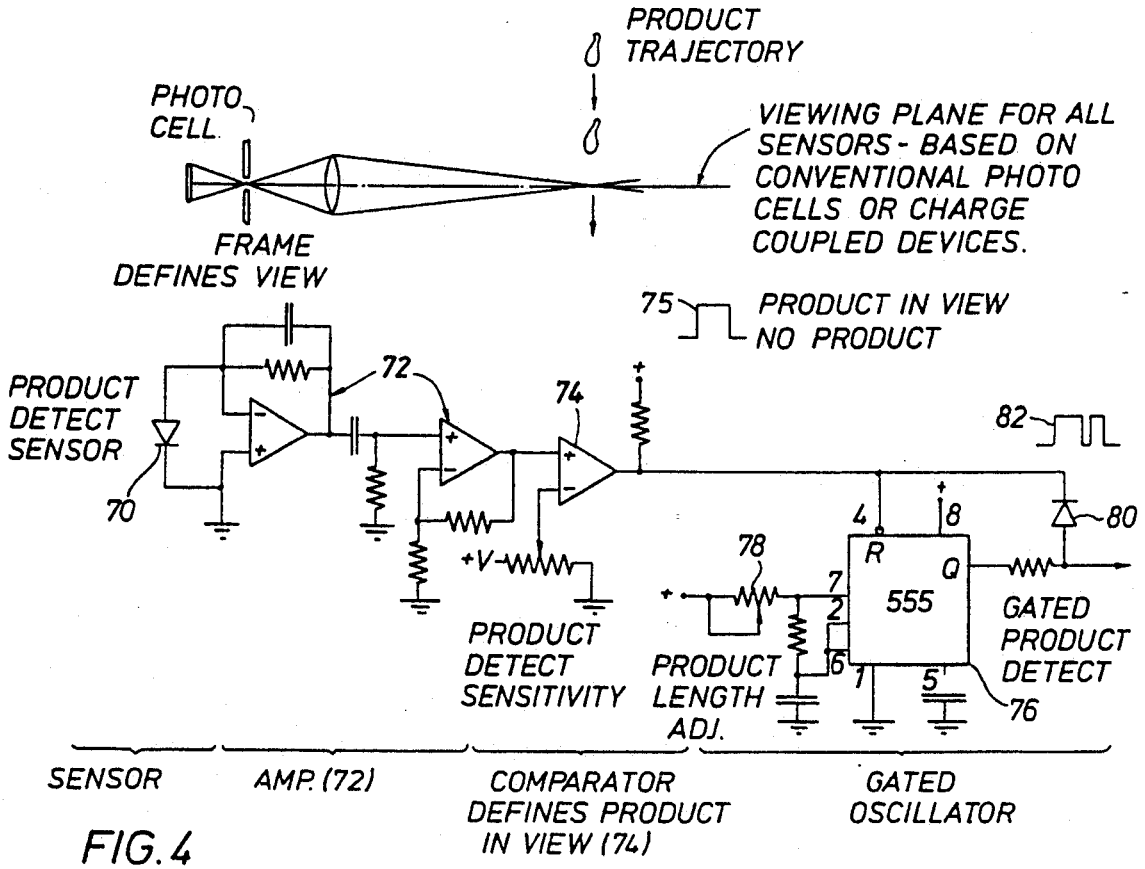
FIG. 4 is a block diagram of a portion of a sorting machine in an operating mode for developing a gated product detect signal relating to assuring that the reject signal occurs at a proper time to reject products classified as substandard.

Now referring to FIG. 4, a suitable circuit is shown for developing a logic output signal related to determining the accurate occurrence of reject signalling when products are classified as defective to actually expel the product from the product flow. A brightly illuminated viewing window is observed, as previously described, by a photodetector trained to view the viewing window. The photodetector develops through a sensor 70, a high gain amplifier 72 and a comparator 74 an output that is a signal that shows either the presence or the absence of signal in the viewing window. The leading edge thereof coincides with the detection of the leading edge of a product within the viewing window and the trailing edge coincides with the detection of the rear or trailing edge of the product within the viewing window. Thus, for the waveform or product detect signal 75 shown, while the product is in the viewing window, the signal is positive and while there is no product within the viewing window, the signal is negative.

A timer device, preferably a type 555 gated oscillator 76, has a product length adjustment input in the form of an adjustable resistor 78. The setting of this resistor determines the length of a full period output for a "typical" length product. Timer 76 receives the positive-going leading edge detection signal, which is the output of comparator 74, and produces as its output a series of predetermined length pulses or periods of positive signals. A pause follows each timer pulse such that the pulse length plus the pause length can be used as the maximum length of an acceptable product, as explained below.

The output of timer 76 and the product detect signal are gated to a single output by diode 80. For a long product or crowded products where the end of the first products overlaps with a second and is not detectable, the product detect signal is still positive after the first pulse of the timer plus a pause, so the timer generates a second pulse. Assuming that the product detect signal soon ends, then gate 80 will produce a waveform 82 such as shown on the right side of FIG. 4. This waveform is a full timer pulse, followed by a standard timer pause, followed by a short pulse. The leading edge of the second pulse is determined by the timer and the trailing edge is determined by the trailing edge of product signal 75.

Figure 5:
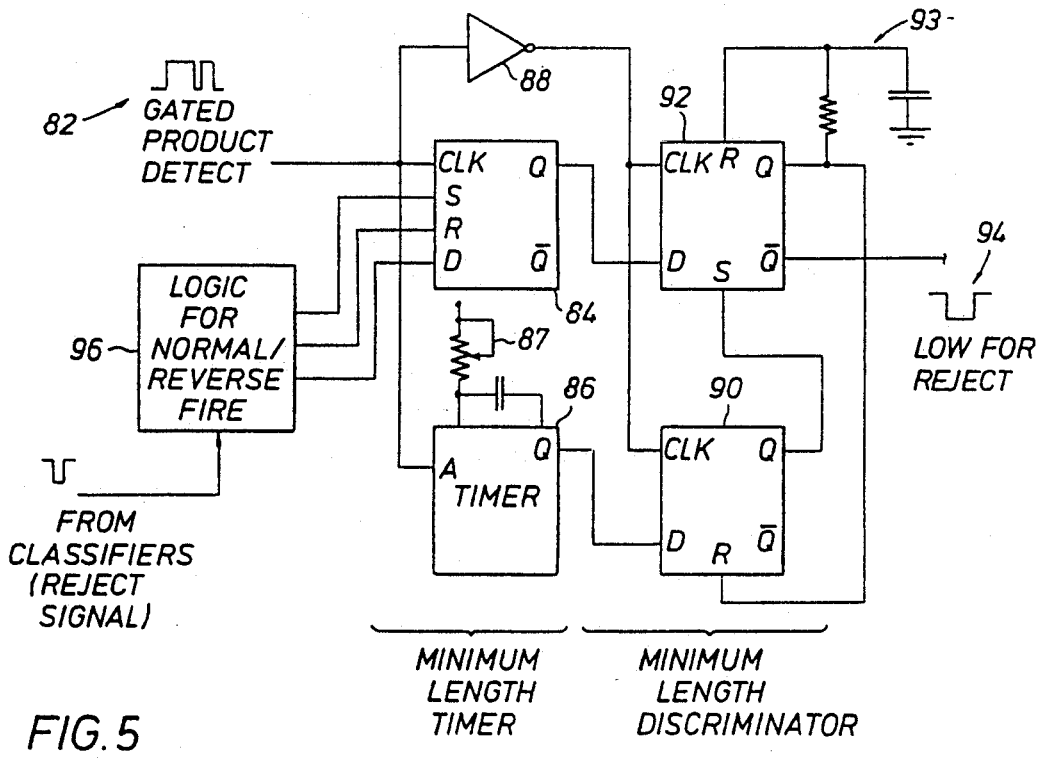
FIG. 5 is a block diagram of a portion of a sorting machine in an operating mode for rejecting unacceptable products that are either too short or too long.

Gated product detect signal 82 is used to activate a reject signal by the network shown in FIG. 5 when there is also a classified product to be rejected as indicated by circuit 96. When there is a trailing edge of a waveform period, there is a negative-going waveform edge. This negative-going edge is converted to a positive-going edge by invertor 88, which clocks D flip-flop 92 to produce a low reject signal 94. This reject signal is canceled after a suitable delay, as established by components 93.

In some instances, however, it is desirable to reject products that are only defective or substandard because of length. Such rejection is capable by the inclusion of monostable timer 86 and D flip-flop 90. The leading edge of waveform 82 activates on timer 86, which is set by a suitable variable resistor 87 to be on for the length of time equivalent to an observed minimum acceptable product. If the timer goes off while waveform 82 is still in its first full period, nothing happens. A short period of waveform 82 will result in producing an output from D flip-flop 92 by the operation of invertor 88 and the clocking of D flip-flop 90 while the output from timer 86 is still high.

If an excessively long product occurs that produces a short second period of waveform 82, the trailing edge of the second part of the waveform may occur while timer 86 is in its second period. This produces a rejection signal in the same fashion as for a short product.

Finally, it is sometimes desirable, especially when there is largely substandard or contaminated products being sorted, to reverse the "fire" so that the normally passed products are rejected and the normally rejected products are passed. This is easily done by providing a simple operator switch for reversing the state of the signal from logic circuit 96. Thus, the leading edge of every product detected enables D flip-flop 84 and only those products that are not classified as rejects through 96 will cancel the reject signal from occurring, as described above.

While several operable embodiments have been described and illustrated, it will be understood that the invention is not limited thereto, since many modification may be made and will become apparent to those skilled in the art. The reject mechanism has been described in association with a particular type of detection sorting. However, it is apparent that detection circuits operating differently can be used with the rejection scheme that has been described above and which is claimed in the claims.

What is claimed is:

1. A product detect circuit in a sorting machine having at least one channel through which fungible products to be sorted flow, are electro-optically observed in a viewing window, and cause a defect signal to occur when observed to be substandard in length, the product detect circuit, comprising a photodetector for observing the viewing window for the presence of at least one product therein and producing a leading edge of a product detection signal with the detection of the front edge of the product in the viewing window and an opposite trailing edge of said product detection signal with the detection of the back edge of said product in the viewing window, a timing for producing pulses of a predetermined length corresponding to a predetermined length corresponding to a predetermined typical product length beginning with the detection of the front edge of said product in the viewing window separated by a predetermined length pause, said pulses continuing as long as there is product detection at the occurrence of the leading edge of each successive pulse, and logic means for producing a product end detect output that is determined by the trailing edge of the product detection signal occurring at a time before the end of a timer pulse, and alternately, by the trailing edge of the timer pulse when the trailing edge of said product detection signal occurs thereafter.

2. A product detector circuit in accordance with claim 1, and including a minimum length rejector, comprising a second timer for producing a pulse beginning with the detection of the first edge of said product and a trailing edge determined by a preset acceptable minimum length product, a rejector for producing a rejection signal when the trailing edge of said product detection signal occurs before the trailing edge of said pulse from said second timer.

3. A product detector circuit in accordance with claim 2, and including a maximum length rejector, wherein said second timer produces a second pulse beginning with the leading edge of the second pulse from said first-named timer, and said rejector produces a rejection signal when the trailing edge of said product detection signal occurs before the trailing edge of said second pulse from said second timer.

4. A product detect circuit in accordance with claim 1, wherein said timer includes a gated oscillator.

5. A product detect circuit in accordance with claim 1, and including detecting sensing means for sensing a substandard product and producing the defect signal, and a rejector including delay means connected to said defect sensing means and to said logic means for activating a reject mechanism at a predetermined time following said product end detect output from said logic means.

6. A method of detecting the end of a product in a series of fungible products to be sorted flowing in a channel of a sorting machine, which comprises observing through a viewing window in the channel for the presence of a product in the stream and producing a leading edge of a product detection signal with the detection of the front edge of the product in the viewing window and an opposite trailing edge of said product detection signal with the detection of the back edge of the product in the viewing window, producing timer pulses of a predetermined length corresponding to a predetermined typical product length beginning with the detection of the front edge of the product in the viewing window separated by a predetermined length pause, said timer pulses continuing as long as there is product detection at the occurrence of the leading edge of each successive timer pulse, and producing a product end detect output that is determined by the trailing edge of the product detection signal occurring at a time before the end of a timer pulse, and alternately, by the trailing edge of the timer pulse when the trailing edge of said product detection signal occurs thereafter.

7. A method in accordance with claim 6, and including sensing the stream of products for a defective product and producing a defect signal when a substandard product is detected, and activating a reject mechanism at a predetermined time following the product end detect output for each substandard product that results in the production of a defect signal.

* * * * *